US007488187B2

(12) United States Patent
Wolf

(10) Patent No.: US 7,488,187 B2
(45) Date of Patent: Feb. 10, 2009

(54) DUAL CHANNEL XLR CABLE CONVERTER

(76) Inventor: Daniel Wolf, 5058 Nadine St., Orlando, FL (US) 32807

( * ) Notice: Subject to any disclaimer, the term of this patent is extended or adjusted under 35 U.S.C. 154(b) by 0 days.

(21) Appl. No.: 12/115,074

(22) Filed: May 5, 2008

(65) Prior Publication Data

US 2008/0274642 A1 Nov. 6, 2008

Related U.S. Application Data

(60) Provisional application No. 60/915,787, filed on May 3, 2007.

(51) Int. Cl.
*H01R 11/00* (2006.01)

(52) U.S. Cl. ..... 439/106; 439/502

(58) Field of Classification Search ..... 439/106, 439/502, 498, 101

See application file for complete search history.

(56) References Cited

U.S. PATENT DOCUMENTS 6,530,085 B1 * 3/2003 Perlman ..... 725/82
6,902,427 B2 * 6/2005 Kuo ..... 439/502
7,229,302 B1 * 6/2007 Lai ..... 439/214
7,416,440 B2 * 8/2008 Homyk et al. ..... 439/502
2001/0053627 A1 * 12/2001 Armistead et al. ..... 439/502
2003/0211775 A1 * 11/2003 Marchand et al. ..... 439/502

* cited by examiner

*Primary Examiner*—Gary F. Paumen
(74) *Attorney, Agent, or Firm*—McKinney Law, PLLC

(57) ABSTRACT

A dual channel XLR cable converter is disclosed. In a particular embodiment, the XLR cable converter includes first and second RCA cables terminating at first and second RCA cable connectors at one end and a XLR cable connector at the opposing end. A first signal pin terminal of the XLR cable connector is in electrical communication with the first signal wire of the first RCA cable. A second signal pin terminal of the XLR connector is in electrical communication with the second signal wire of the second RCA cable. A common ground pin terminal of the XLR cable connector is in electrical communication with the first grounding wire of the first RCA cable and a second grounding wire of the second RCA cable. Therefore, the XLR cable converter can be used for conveying single channel RCA cable signals over dual channel XLR cable.

21 Claims, 2 Drawing Sheets

DUAL CHANNEL XLR CABLE CONVERTER

I. CROSS REFERENCE TO RELATED APPLICATIONS

This application claims the benefit of U.S. Provisional Application No. 60/915,787 filed May 3, 2007. The disclosure of the provisional application is incorporated herein by reference.

II. FIELD

The present disclosure relates generally to the field of XLR cables, and in particular to an XLR connector for converting a single channel electrical cable to a dual channel electrical cable.

III. DESCRIPTION OF RELATED ART

The prior art single channel cable is known as XLR cable and is typically used to transmit a single balanced audio signal. An RCA connector is a type of electrical connector known in the audio/video art. The RCA connector includes a central male terminal surround by a grounding ring. Electrical devices receive the RCA connector by supplying a central hole with a ring of metal, which is slightly small in diameter than the ring on the RCA connector. A shortcoming of an RCA connector is that each signal requires its own wire. Accordingly, what is needed in the art is a dual channel XLR cable converter to utilize existing XLR cable to transmit two channels that can carry audio and video or other similar unbalanced signals.

An S-connector typically includes four (4) terminals that are used to carry video data as two separate signals. It does not carry audio signals on the same cable. Accordingly, what is needed in the art is a device that can convert standard XLR cable for use with a variety of different types of connectors and audio and video signals, including, either analog or digital signals, or any combination thereof. Some examples include stereo headphones, audio and video, MIDI, 1394 Firewire, telephone or USB, to name a few.

Another shortcoming of the prior art is that the connectors for XLR cable are not adaptable to RCA-type connectors or S-connectors.

Notwithstanding the existence of such prior art cable connectors, there is a need for an improved connector and cable converter apparatus that is adaptable to many scenarios and is easy to use.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

IV. SUMMARY

In a particular embodiment, a dual channel XLR cable converter is disclosed. The dual channel XLR cable converter includes a first and second XLR connector. The first XLR connector includes a housing with three female pin terminals adaptable to receive opposing three male pin terminals of a second XLR connector so that when the XLR connectors are mated together, an electrical communication pathway is established over an XLR cable. In addition, each XLR connector further includes two RCA cables and two RCA connectors. The RCA cables each having a signal-carrying wire and a grounding wire. The first and second XLR connectors are wired similarly so that continuity of the electrical signal is provided over the XLR cable.

One particular advantage provided by embodiments of the dual channel XLR cable converter is that the signal-carrying wire of the first RCA cable is in electrical communication with a first pin terminal of an XLR connector to carry a first signal. The signal-carrying wire of the second RCA cable is in electrical communication with a second pin terminal of said XLR connector to carry a second signal. The grounding wire of the first RCA cable and second RCA cable is in electrical communication with a third pin terminal of said XLR connector so that said first and second signal-carrying wires share the same common ground.

Another particular advantage provided by the embodiments of the dual channel XLR cable converter is that existing XLR cable (or other types of dual channel cable) installed in facilities can be used with any type of equipment regardless if the equipment is single channel. Accordingly, this reduces time and expense for setting up and tearing down for an event by not having to run single channel cable.

Other aspects, advantages, and features of the present disclosure will become apparent after review of the entire application, including the following sections: Brief Description of the Drawings, Detailed Description, and the Claims.

V. BRIEF DESCRIPTION OF THE DRAWINGS

VI. DETAILED DESCRIPTION

Figure 1:
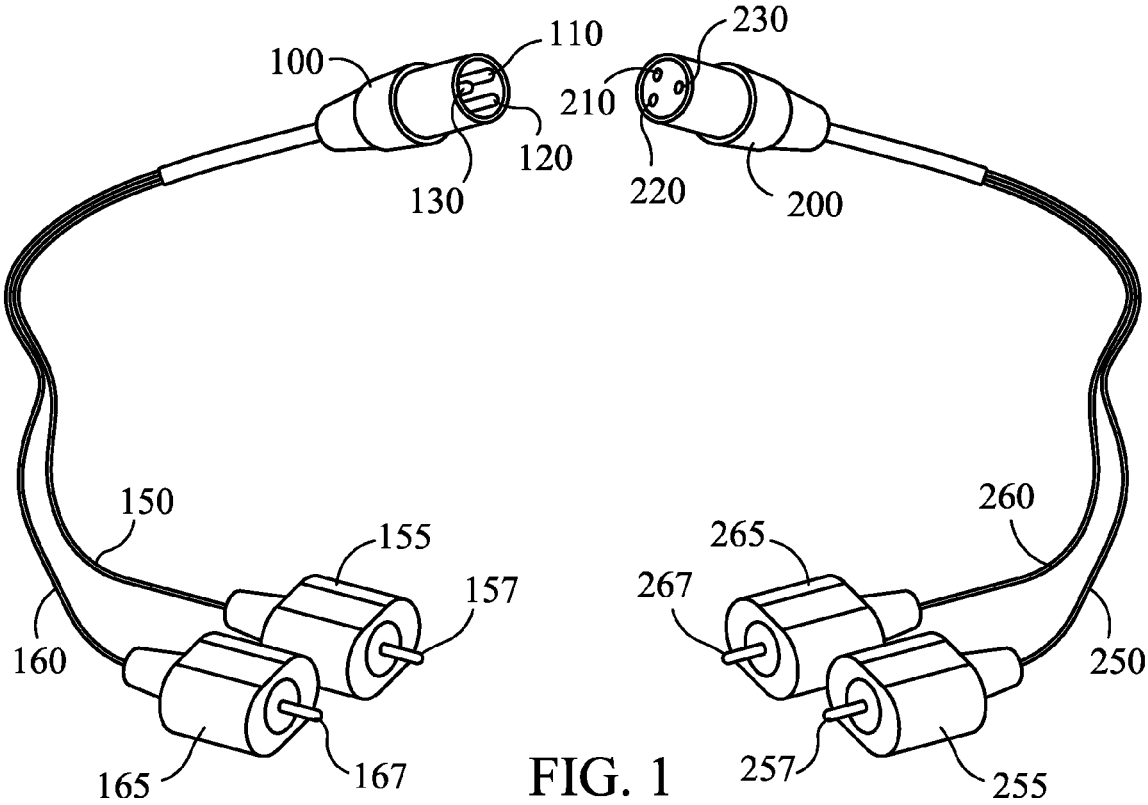
FIG. 1 is a perspective view of the dual channel cable converter of an embodiment of the present invention.

Referring to FIG. 1, a particular illustrative embodiment of a dual channel XLR cable converter is disclosed. A first XLR connector 100 of the present invention having a housing with three male pin terminals 110, 120, 130 adaptable to receive opposing three female pin terminals 210, 220, 230 of a second XLR connector 200. The first XLR connector 100 further includes two RCA cables 150, 160 and two RCA connectors 155 and 165. The dual channel XLR cable converter can be used with analog and/or digital signals. In use, two RCA connectors 155, 165 are plugged into a first piece of equipment (e.g., wireless microphone receiver) and the first connector 100 is connected to a first end of an existing XLR cable (not shown). A second XLR connector 200 is connected to a second end of the existing XLR cable and the two RCA connectors 255 and 265 are plugged into a second piece of equipment (e.g., a soundboard) thereby providing a pathway for single channel signals to travel over dual channel cable. The present invention is adaptable to convert any single channel cable signals to be carried over dual channel cable.

Figure 2:
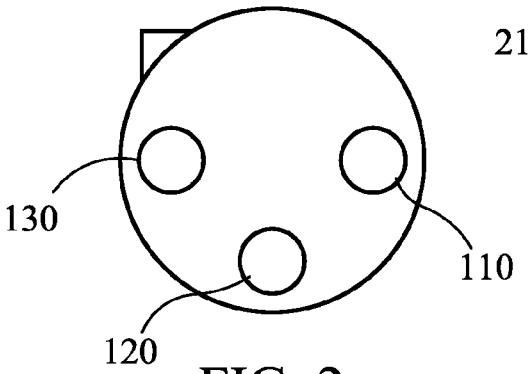
FIG. 2 is a front view of a male XLR converter of an embodiment of the present invention.
Figure 3:
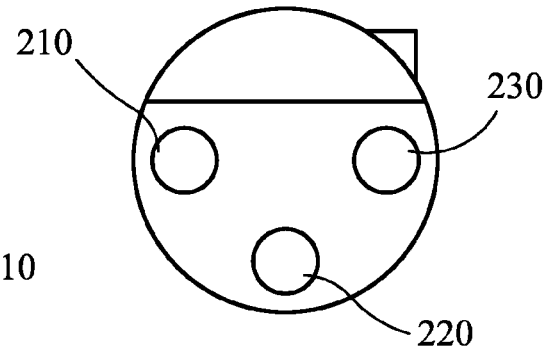
FIG. 3 is a front view of a female XLR converter of an embodiment of the present invention.

Referring now to FIG. 2 shows first XLR connector 100 and the male pin configuration 110, 120, 130. FIG. 3 shows the female pin configuration. Male pin terminal 110 and female terminal 210 are the grounding wires for the XLR cable. Male pin terminal 120 and female terminal 220 function as inverted polarity or "cold" and male pin terminal 130 and female terminal 230 function as normal polarity or "hot."

Figure 4:
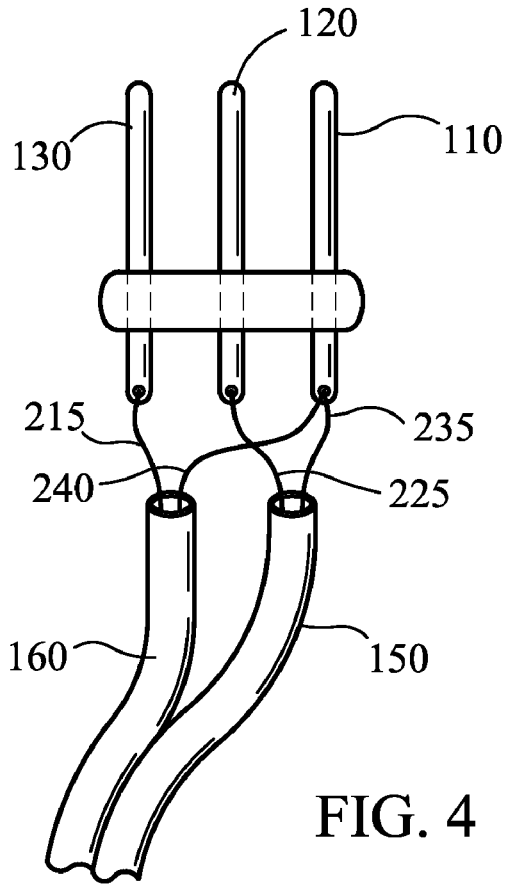
FIG. 4 is an elevational view of a male XLR converter of an embodiment of the present invention.

Referring now to FIG. 4, the RCA cable 160 includes a signal-carrying wire 215, which is in electrical communication with male terminal pin 130 and a grounding wire 240 connected to male pin terminal 110 that is the common ground. A second RCA cable 150 includes a second signal-carrying wire 225, which is in electrical communication with male terminal pin 120 and grounding wire 235 connected to the male pin terminal 110 ground.

The second XLR connector 200 with the female terminal configuration is similarly wired as the first XLR connector. For example, the RCA cable 260 includes a signal-carrying wire, which is in electrical communication with female terminal pin 230 and a grounding wire connected to female pin terminal 210 that is the common ground. A second RCA cable 250 includes a second signal-carrying wire, which is in electrical communication with female terminal pin 220 and grounding wire connected to the female pin terminal 210 ground.

Figure 5:
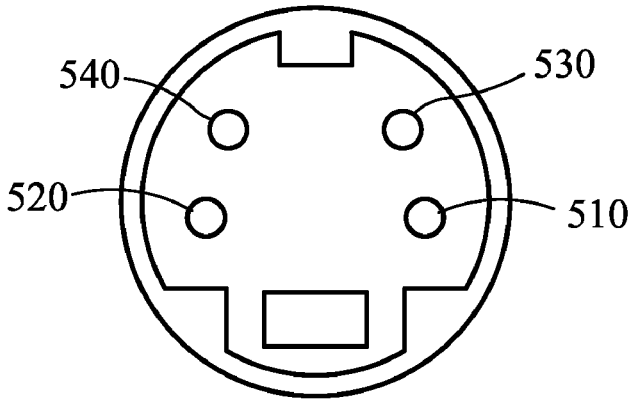
FIG. 5 is a front view of an S-video cable converter of an embodiment of the present invention.

FIG. 5 shows a second embodiment of the dual channel XLR connector using a S-video type connector instead of RCA connectors. Pins 510, 520 serve to connect to the ground and pin 530 carries the signal for video intensity (luminance) and pin 540 is carries the signal for color (chrominance).

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A dual channel XLR cable converter device comprising:

a first and a second XLR cable connector;

the first XLR cable connector comprising a plurality of male pin terminals;

the first XLR cable connector further comprising a first RCA cable terminating at a first RCA cable connector wherein the first RCA cable having a first signal-carrying wire and a first grounding wire;

the first XLR cable connector further comprising a second RCA cable terminating at a second RCA cable connector wherein the second RCA cable having a second signal-carrying wire and a second grounding wire;

the second XLR cable connector comprising a plurality of female pin terminals;

the second XLR cable connector further comprising a third RCA cable terminating at a third RCA cable connector wherein the third RCA cable having a third signal-carrying wire and a third grounding wire; and the second XLR cable connector further comprising a fourth RCA cable terminating at a fourth RCA cable connector wherein the fourth RCA cable having a fourth signal-carrying wire and a fourth grounding wire.

2. The dual channel XLR cable converter of claim 1 further adapted to provide an electrical communication pathway over a length of XLR cable using a third standard XLR cable connector on a first end of the XLR cable and a fourth standard XLR cable connector on a second end of the XLR cable wherein the first XLR cable connector adapted to removably mate to the third standard XLR cable connector of the XLR cable and the second XLR cable connector is adapted to removably mate to the fourth XLR cable connector.

3. The dual channel XLR cable converter of claim 2 wherein the third XLR cable connecter of the XLR cable having a plurality of female pin terminals adaptable to removably receive the plurality of male pin terminals of the first XLR cable connector.

4. The dual channel XLR cable converter of claim 3 wherein the fourth XLR cable connector of the XLR cable having a plurality of male pin terminals adaptable to insert into the plurality of female pin terminals of the second XLR cable connector.

5. The dual channel XLR cable converter of claim 1 wherein the plurality of male pin terminals comprising a first signal male pin terminal in electrical communication with the first signal wire of the first RCA cable.

6. The dual channel XLR cable converter of claim 5 wherein the plurality of male pin terminals comprising a second signal male pin terminal in electrical communication with the second signal wire of the second RCA cable.

7. The dual channel XLR cable converter of claim 6 wherein the plurality of male pin terminals comprising a first common ground male pin terminal in electrical communication with the first grounding wire of the first RCA cable and the second grounding wire of the second RCA cable.

8. The dual channel XLR cable converter of claim 7 wherein the plurality of female pin terminals comprising a third signal female pin terminal in electrical communication with the third signal wire of the third RCA cable.

9. The dual channel XLR cable converter of claim 8 wherein the plurality of female pin terminals comprising the fourth signal female pin terminal in electrical communication with a fourth signal wire of the fourth RCA cable.

10. The dual channel XLR cable converter of claim 9 wherein the plurality of female pin terminals comprising a second common ground female pin terminal in electrical communication with the third grounding wire of the third RCA cable and the fourth grounding wire of the fourth RCA cable.

11. A dual channel XLR cable converter device comprising:

a first and a second XLR cable connector;

the first XLR cable connector comprising a plurality of male pin terminals;

the first XLR cable connector further comprising a first cable terminating at a first S-connector wherein the first cable having a first signal-carrying wire, a first grounding wire, a second signal-carrying wire and a second grounding wire;

the second XLR cable connector comprising a plurality of female pin terminals; and the second S-connector further comprising a third cable terminating at a third S-connector wherein the third cable having a third signal-carrying wire, a third grounding wire, a fourth signal-carrying wire and a fourth grounding wire.

12. The dual channel XLR cable converter of claim 11 further adapted to provide an electrical communication pathway over a length of XLR cable using a length of cable having a third standard XLR cable connector on a first end of the XLR cable and a fourth standard XLR cable connector on a second end of the XLR cable wherein the first XLR cable connector adapted to removably mate to the third standard XLR cable connector of the XLR cable and the second XLR cable connector is adapted to removably mate to the fourth XLR cable connector.

13. The dual channel XLR cable converter of claim 12 wherein the third XLR cable connecter of the XLR cable having a plurality of female pin terminals adaptable to removably receive the plurality of male pin terminals of the first XLR cable connector.

14. The dual channel XLR cable converter of claim 13 wherein the fourth XLR cable connector of the XLR cable having a plurality of male pin terminals adaptable to insert into the plurality of female pin terminals of the second XLR cable connector.

15. The dual channel XLR cable converter of claim 11 wherein the plurality of male pin terminals comprising a first signal male pin terminal in electrical communication with the first signal wire of the first RCA cable.

16. The dual channel XLR cable converter of claim 15 wherein the plurality of male pin terminals comprising a second signal male pin terminal in electrical communication with the second signal wire of the second RCA cable.

17. The dual channel XLR cable converter of claim 16 wherein the plurality of male pin terminals comprising a first ground male pin terminal in electrical communication with the first grounding wire of the first cable and a second ground male pin terminal in electrical communication with the second grounding wire of the second cable.

18. The dual channel XLR cable converter of claim 17 wherein the plurality of female pin terminals comprising a third signal female pin terminal in electrical communication with the third signal wire of the third cable.

19. The dual channel XLR cable converter of claim 18 wherein the plurality of female pin terminals comprising the fourth signal female pin terminal in electrical communication with a fourth signal wire of the fourth cable.

20. The dual channel XLR cable converter of claim 19 wherein the plurality of female pin terminals comprising a second common ground female pin terminal in electrical communication with the third grounding wire of the third cable and the fourth grounding wire of the fourth cable.

21. A method of carrying single channel cable signals over dual channel cable, the method comprising:

providing a first and second single channel cables terminating at first and second single channel cable connectors at one end and a dual channel cable connector at the opposing end;

connecting a first signal pin terminal of the dual channel cable connector with a first signal wire of the first single channel cable;

connecting a second signal pin terminal of the dual channel connector with the second signal wire of the second dual channel cable; and connecting a common ground pin terminal of the dual channel cable connector with the first grounding wire of the first single channel cable and a second grounding wire of the second single channel cable.

* * * * *